US006257219B1

(12) United States Patent
McPherson

(10) Patent No.: US 6,257,219 B1
(45) **Date of Patent: *Jul. 10, 2001**

(54) ELASTICALLY MOUNTED COUNTER WEIGHT

(75) Inventor: Mathew A. McPherson, 19055 Incline Rd., Norwalk, WI (US) 54648

(73) Assignee: Mathew A. McPherson, Norwalk, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/502,149

(22) Filed: Feb. 11, 2000

Related U.S. Application Data

(63) Continuation-in-part of application No. 09/266,184, filed on Mar. 10, 1999, now Pat. No. 6,039,035.

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS

| | | | |
|---|---|---|---|
| D. 331,614 | 12/1992 | Martin et al. | D22/107 |
| 3,841,295 | 10/1974 | Hunter | 124/25.6 |
| 3,854,467 | 12/1974 | Hofmeister | 124/25.6 |
| 3,958,551 | 5/1976 | Ketchum | 124/25.6 |
| 3,993,039 | 11/1976 | Groves et al. | 124/25.6 |
| 4,372,285 | 2/1983 | Simonds et al. | 124/90 |
| 4,401,097 | 8/1983 | Simonds et al. | 124/25.6 |
| 4,438,753 | 3/1984 | Simonds | 124/25.6 |
| 4,440,142 | 4/1984 | Simonds | 124/25.6 |
| 4,458,657 | 7/1984 | Stockmar | 124/17 |
| 4,461,267 | 7/1984 | Simonds et al. | 124/25.6 |
| 4,478,203 | 10/1984 | Hayes | 124/25.6 |
| 4,512,326 | 4/1985 | Jarrett | 124/25.6 |
| 4,660,536 | 4/1987 | McPherson | 124/25.6 |
| 4,827,894 | 5/1989 | Schallberger | 124/25 |
| 4,838,236 | 6/1989 | Kudlacek | 124/25.6 |
| 4,909,231 | 3/1990 | Larson | 124/23.1 |
| 4,993,399 | 2/1991 | Chattin | 124/25.6 |
| 5,005,554 | 4/1991 | Shepley et al. | 124/24.1 |
| 5,040,520 | 8/1991 | Nurney | 124/25.6 |
| 5,174,268 | 12/1992 | Martin et al. | 124/25.6 |
| 5,307,787 | 5/1994 | LaBorde et al. | 124/25.6 |
| 5,368,006 | 11/1994 | McPherson | 124/25.6 |
| 5,495,843 | 3/1996 | Larson | 124/25.6 |
| 5,505,185 | 4/1996 | Miller | 124/25.6 |
| 5,515,836 | 5/1996 | Martin et al. | 124/23.1 |
| 5,638,804 | 6/1997 | Remick et al. | 124/25.6 |
| 5,678,529 | 10/1997 | Larson | 124/25.6 |
| 5,782,229 | 7/1998 | Evans et al. | 124/25.6 |
| 5,809,982 | 9/1998 | McPherson | 124/25.6 |
| 5,934,265 | 8/1999 | Darlington | 124/25.6 |
| 6,039,035 * | 3/2000 | McPherson | 124/25.6 |

* cited by examiner

*Primary Examiner*—John A. Ricci
(74) *Attorney, Agent, or Firm*—Vidas, Arrett & Steinkraus, P.A.

(57) ABSTRACT

A rotating member for use with a compound bow, including a body having a rotation point for journaling the body to a bow limb, the body including a damping device for absorbing vibrational energy as the rotating member vibrates against a bow string when the rotating member returns to a rest position from a drawn position.

37 Claims, 11 Drawing Sheets

ELASTICALLY MOUNTED COUNTER WEIGHT

CROSS-REFERENCE TO RELATED APPLICATIONS

This is a continuation in part application of U.S. patent application Ser. No. 09/266,184, filed Mar. 10, 1999 entitled "ELASTICALLY MOUNTED COUNTERWEIGHT FOR A CAM OR PULLEY", now U.S. Pat. No. 6,039,035, the entire contents of which are hereby incorporated by reference.

BACKGROUND OF THE INVENTION

Applicant is the inventor of U.S. Pat. No. 5,809,982, which issued Sep. 22, 1998 and was entitled "Compound Bow With Counteracting Weight", the entire contents of which are hereby incorporated by reference.

When a cam returns to the rest position after the bow is shot, it vibrates or oscillates back and forth very quickly, along with the bowstring, with the vibration damping out over a short period of time. Applicant has discovered that by mounting the counterweight elastically or resiliently to the cam and/or the idler wheel , the vibration is more quickly dampened out because the counterweight acts in opposition to the vibration, as well as providing the other benefits discussed in connection with U.S. Pat. No. 5,809,982.

BRIEF SUMMARY OF THE INVENTION

The inventive elastically mounted counterweight is comprised of a body having a rotation point for journaling the body to a bow limb. The body includes a damping device for absorbing vibrational energy as the rotating member vibrates against a bowstring when the rotating member returns to a rest position from a drawn position.

The rotating member may either be a cam or a pulley and may either be used on a single rotating member or both rotating members on the bow.

The damping device may be a counterweight which is either resiliently or elastically mounted to the body, such as carrying the counterweight in a rubber mounting ring.

The end of the extension arm may itself be elastically or resiliently mounted to the remainder of the extension arm to dampen vibration, either alone or in combination with the elastically mounted counterweight.

These and other more detailed and specific objectives and an understanding of the invention will become apparent from a consideration of the following Detailed Description of the Invention in view of the Drawings.

Other inventions which may be utilized with, or which may be otherwise relevant to, the present invention are disclosed in the following concurrently filed and commonly assigned applications: U.S. application Ser. No. 09/503,013, entitled "Bow Vibration Damper"; U.S. application Ser. No. 09/502,643, entitled "Dual Feed Pivoting Feed-Out"; U.S. application Ser. No. 09/502,354, entitled "Round Wheel Cam"; U.S. application Ser. No. 09/502,917, entitled "Archery Bow with Bow String Coplanar with the Longitudinal Axis of the Bow Handle"; and U.S. application Ser. No. 09/502,152, entitled "Level Nocking Point Travel Cam".

For the purpose of this disclosure, all US patents and patent applications and all other publications referenced herein are incorporated herein by reference in their entirety.

DETAILED DESCRIPTION OF THE INVENTION

Figure 1:
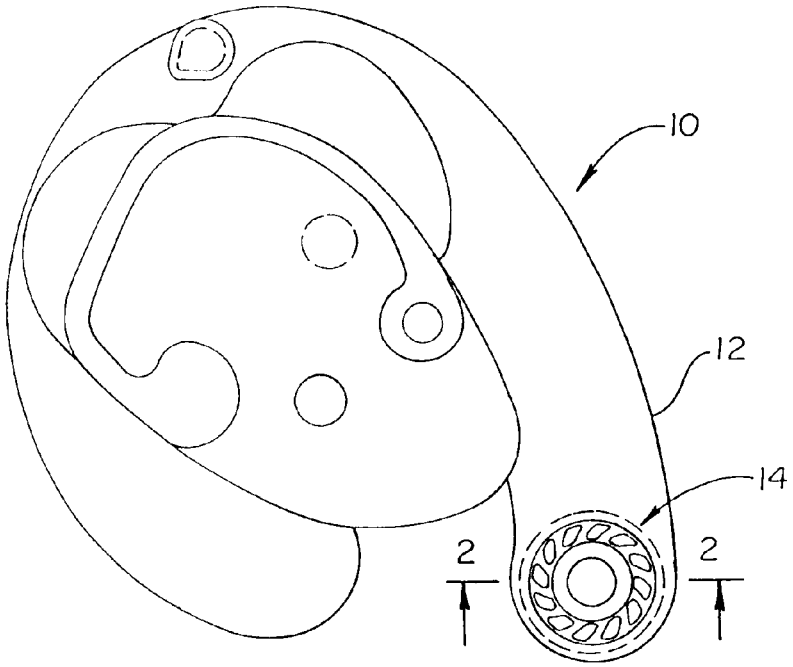
FIG. 1 is a top view of the inventive elastically mounted counterweight in a cam.

While this invention may be embodied in many different forms, there are shown in the drawings and described in detail herein a specific preferred embodiment of the invention. The present disclosure is an exemplification of the principles of the invention and is not intended to limit the invention to the particular embodiment illustrated.

Figure 2:
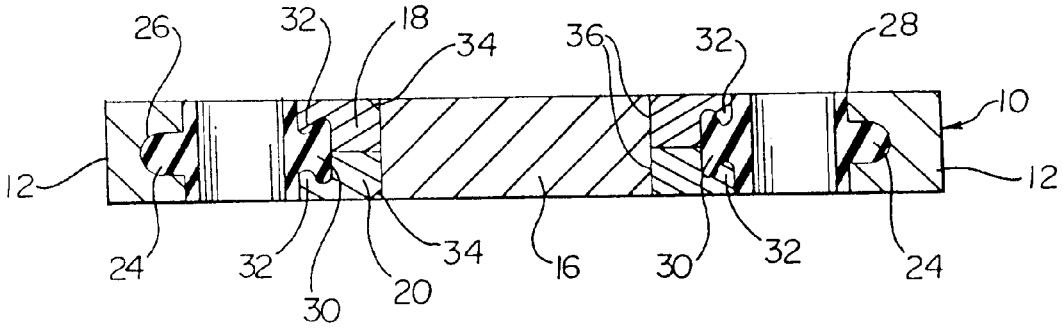
FIG. 2 is a cross sectional view of the rubber ring of the preferred embodiment.
Figure 3:
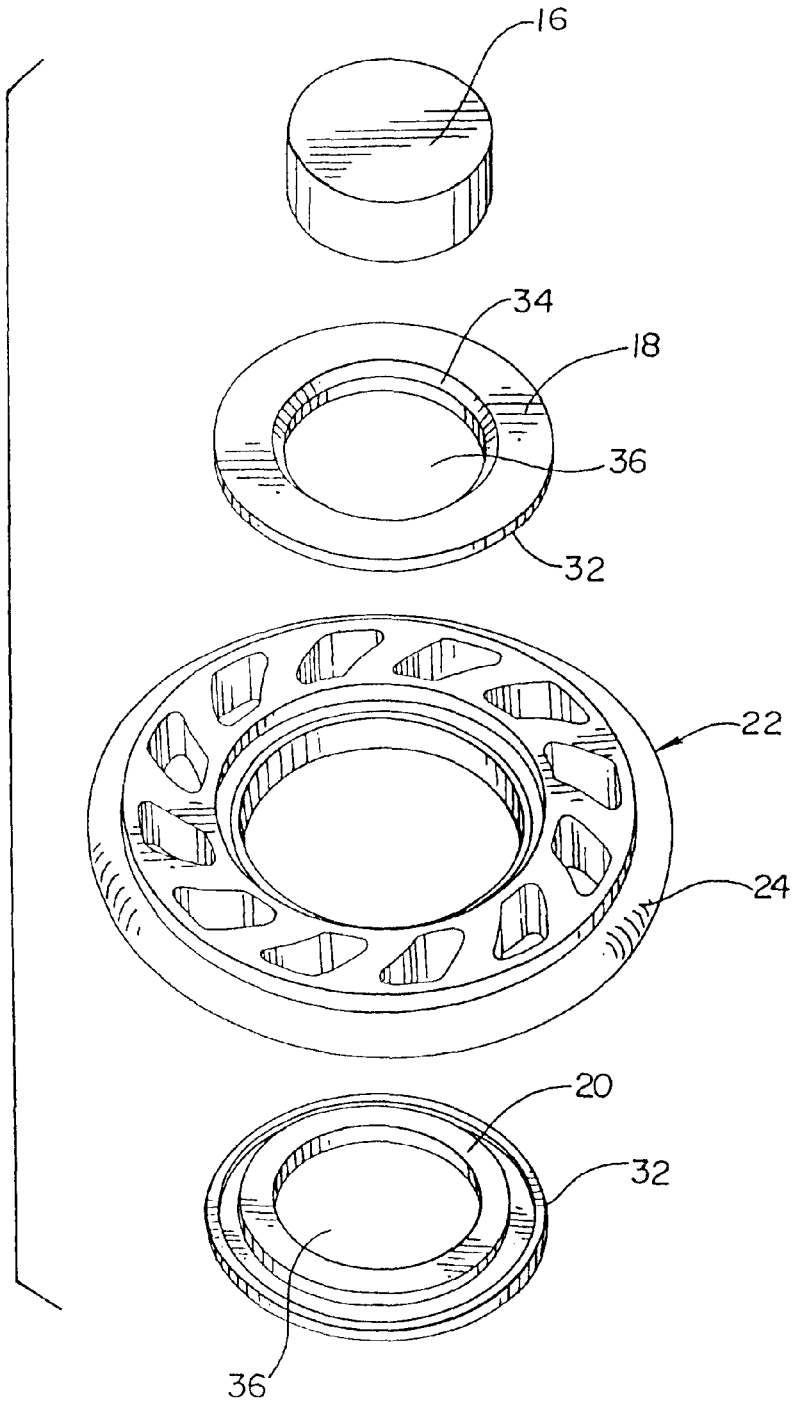
FIG. 3 is an exploded perspective view of the counterweight and the locking rings used to connect it to the rubber ring.

Referring now to FIGS. 1–3, a cam is shown generally at 10 in FIG. 1. The cam includes an extension arm 12 and an elastically or resiliently mounted counterweight, shown generally at 14. As seen best in FIG. 3, a weight 16 is press fit between a top and bottom locking rings, shown respectively at 18 and 20. A rubber ring, shown generally at 22 contains a lip 24 which is received by a slot or groove 26 in a mounting chamber 28 of the extension arm 12. The rubber ring 22 contains a double sided flange 30. The top and bottom locking rings 18 and 20 contain lips 32 which fit around flange 30 to lock the rings to rubber ring 22. This can be seen best in FIG. 2. Locking rings 18 and 20 are beveled at 34 and have openings 36 sized to friction fit with weight 16.

To assemble resiliently mounted counterweight 14, the lip 24 of the resilient rubber ring 22 is inserted into slot or groove 26 in the cam 10. Then the locking rings 18 and 20 are mounted around flange 30 and the weight 16 is press fit into openings 36, which locks the weight 16 and locking rings 18 and 20 to the rubber ring 22. With the weight 16 installed as described the resiliency of rubber ring 22 is reduced locking the lip 24 of the rubber ring into slot or groove 26 in cam 10.

Ring 22 may be made of any elastic or resilient energy absorbing material, such as for example sorbothane, or rubber, or a thermoplastic or thermoset elastomer, although it is made of Dupont ALCYN® 2080BK, a thermoplastic elastomer, in the preferred embodiment. Weight 16 may be made of any material, but is made of tungsten carbide in the preferred embodiment. It is preferable that weight 16 be made of a material which is denser than the material of the cam, which is an aluminum alloy in the preferred embodiment. Locking rings 18 and 20 may be made of any suitable metal or alloy, but in the preferred embodiment are made of brass or an alloy of brass.

Figure 4:
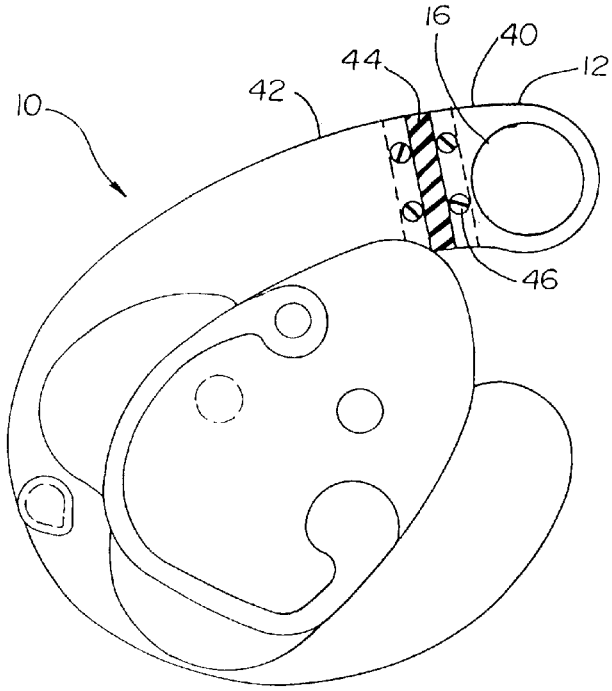
FIG. 4 is a top view of an alternate embodiment of the elastically mounted counterweight.

Referring now to FIG. 4, an alternate embodiment is shown in which cam 10 is shown with a counterweight 16 press fit into extension arm 12. Extension arm 12 is comprised of an end or tip portion 40, which is elastically attached to a base portion 42 by means of rubber connector 44. Rubber connector 44 has lips extending from each end which fit into a slot or groove in the ends of 40 and 42. Screws 46 are used to fasten 40, 42 and 44 together. It should be understood that counterweight 16 could itself be elastically mounted in extension arm 14 as shown in FIG. 1.

Figure 5:
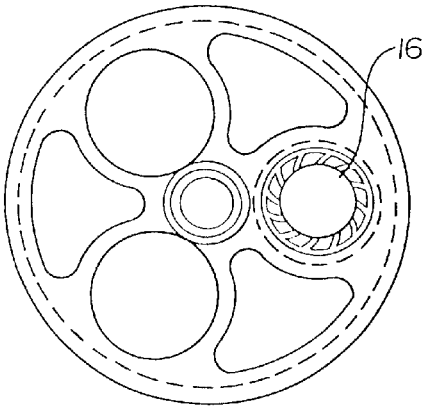
FIG. 5 is a top view of a pulley with a single counterweight elastically mounted.
Figure 6:
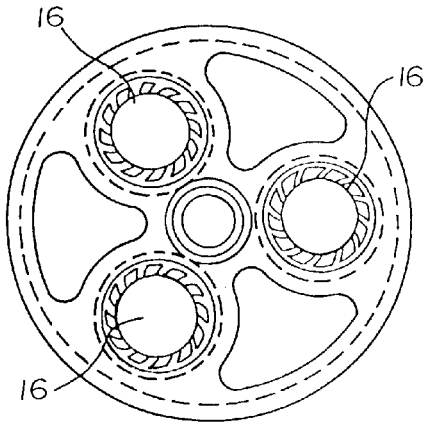
FIG. 6 is a top view of a pulley with three counterweights elastically mounted.

FIG. 5 shows a pulley in which a counterweight 16 is elastically mounted as shown in connection with FIGS. 1–3. FIG. 6 shows a pulley in which three counterweights 16 are elastically mounted as shown in connection with FIGS. 1–3. The counterweights of FIG. 6 are evenly spaced around the periphery of the pulley.

Figure 7:
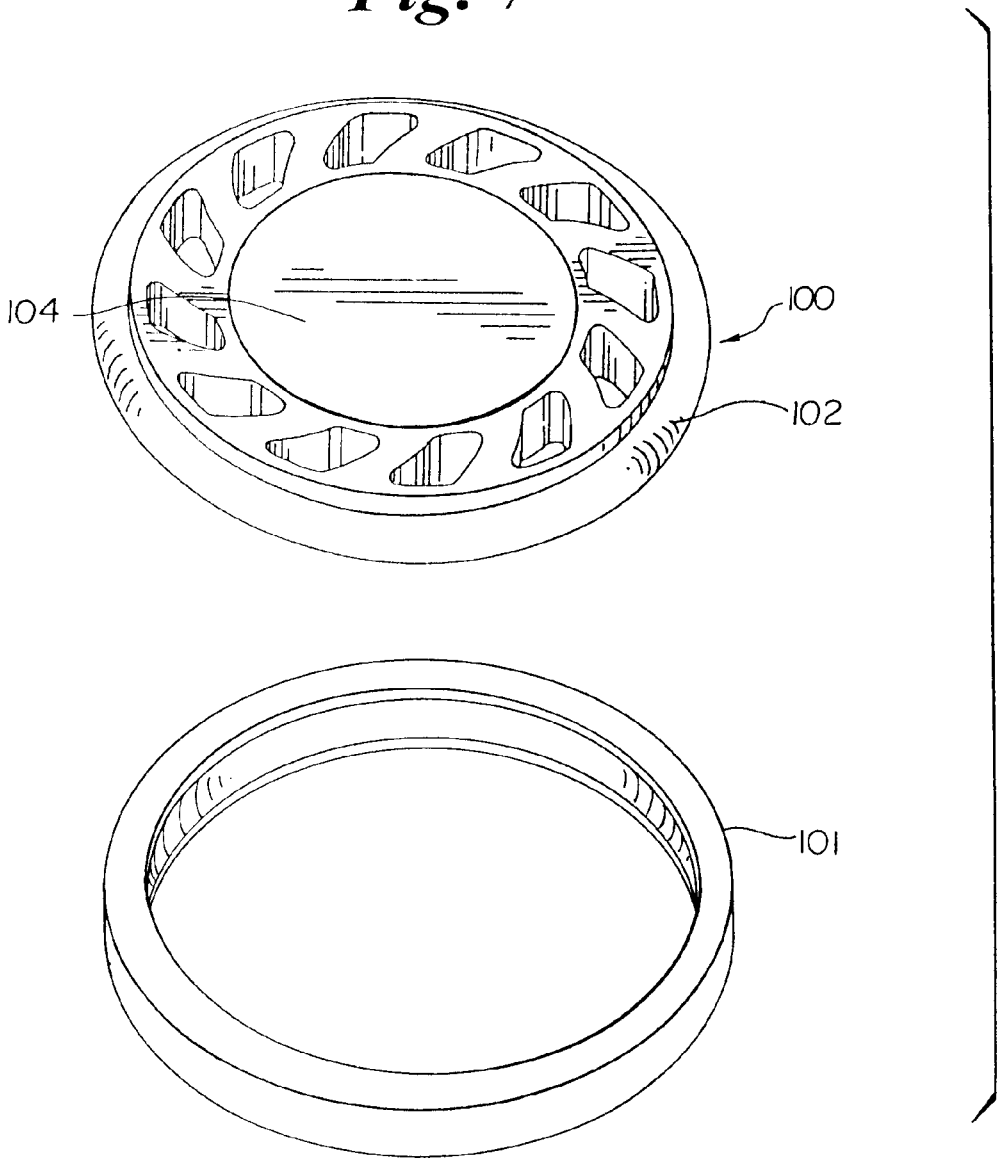
FIG. 7 is an exploded perspective view of another embodiment of the invention.

In FIG. 7 an alternative embodiment of the elastically mounted counter weight is shown. The elastically mounted counter weight or damper is indicated generally at 100. Damper 100 may have a variety of configurations and in the embodiment shown includes a housing 101, and elastomeric portion 102 and a weighted portion 104.

The housing 101 is not an essential component of the damper 100. The housing may be incorporated to provide the damper 100 with the ability to be rigidly or fixedly attached to the surface of a rotating member such as a cam or pulley as previously described.

The housing 101 may be constructed from virtually any solid material. Preferably, the material for the housing 101 should be fairly rigid and light in weight, such materials may include but are not limited to plastic and aluminum.

The attachment means for attaching any portion of any of the various embodiments of the damper 100 to the rotating member as may be described herein, may be embodied by many different devices or attachment methods. Preferably, the housing is secured to the cam or pulley through the application of an adhesive such as: a cyanoacrylate, an epoxy, silicon RTV or other suitable adheasive to the surface of the component and housing.

The elastomeric portion 102 is preferably elastic, and may be constructed in whole or in part from a variety of materials including: Anylin™, Santoprene™, rubber or other suitable material. Other materials may be used which provide the dampener 100 with the desired vibrational dampening characteristics as previously described.

Figure 8:
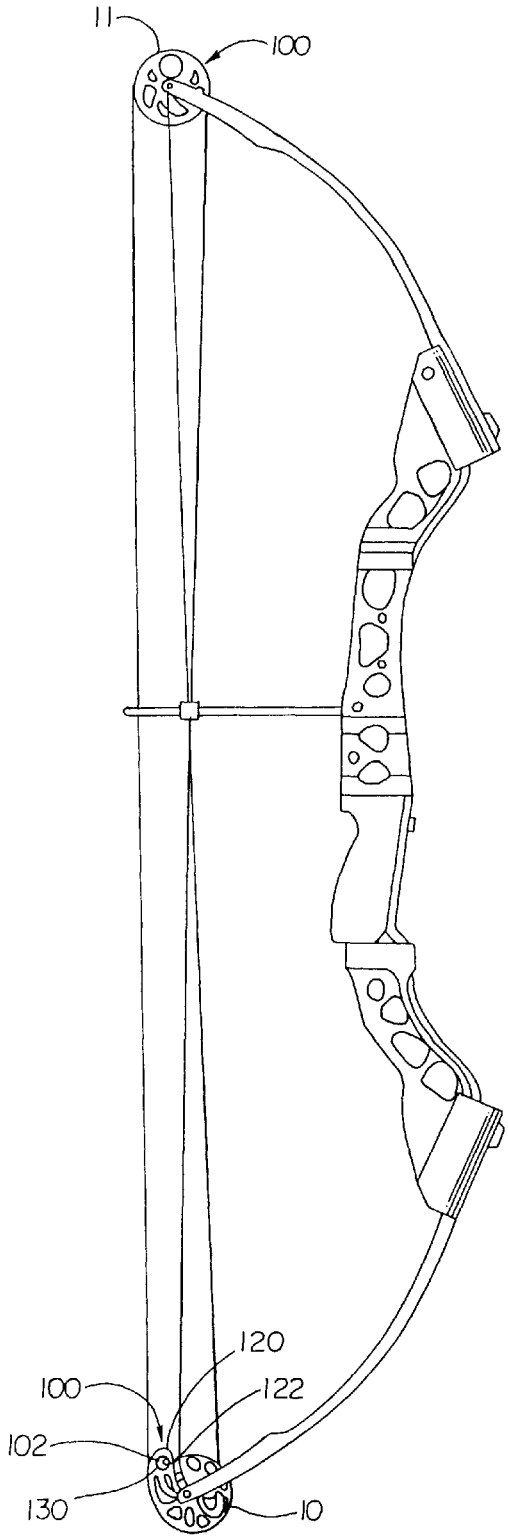
FIG. 8 is a side view of a typical compound bow equipped with embodiments of the present invention.

In an alternative embodiment shown in FIG. 8, the damper 100 may be incorporated directly into the rotating member, or the rotating member may be easily retrofitted to accept the damper 100. 10 In order to include a damper 100 with a cam 10 or pulley 11 of a compound bow such as may be seen in FIG. 8, the cam or pulley must be designed with at least one space or area of sufficient size to allow the damper 100 to be received therein. Preferably, the cam or pulley is machined to correspond to the size and shape of the damper 100. As may best be seen in FIG. 9 and 10 a damper mounting region 120 is provided for in the cam 10 and pulley 11 respectively. The mounting region 120 is sized according to the dimensions of the resilient portion 102. The mounting region 120 includes an inner surface 122.

The inner surface 122 of the mounting region 120 may include additional surface features such as protrusions and/or indentations to provide for engagement between the inner surface 122 and the outside 123 of the elastomeric portion 102. In the embodiment presently shown in FIGS. 9 and 10, the inner surface 122 includes a first retaining groove 124 previously mentioned. In the present embodiment the first retaining groove 124 receives and engages an annular collar 126 which is a raised portion of the outside 130 of the elastomeric portion 102.

Figure 11:
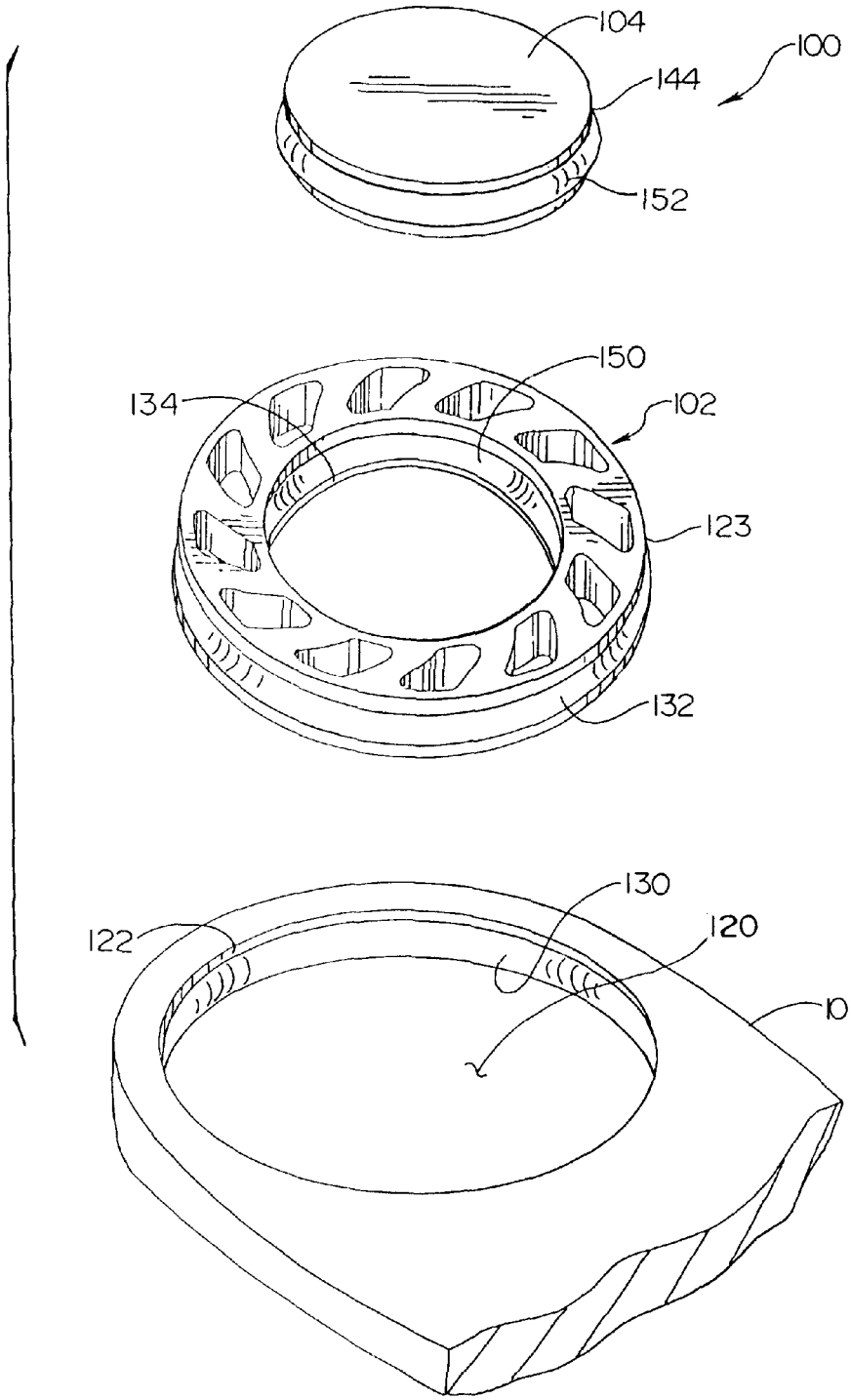
FIG. 11 is a close up partially exploded view of another embodiment of the present invention which illustrates an alternative means of attaching the damper to a cam.
Figure 12:
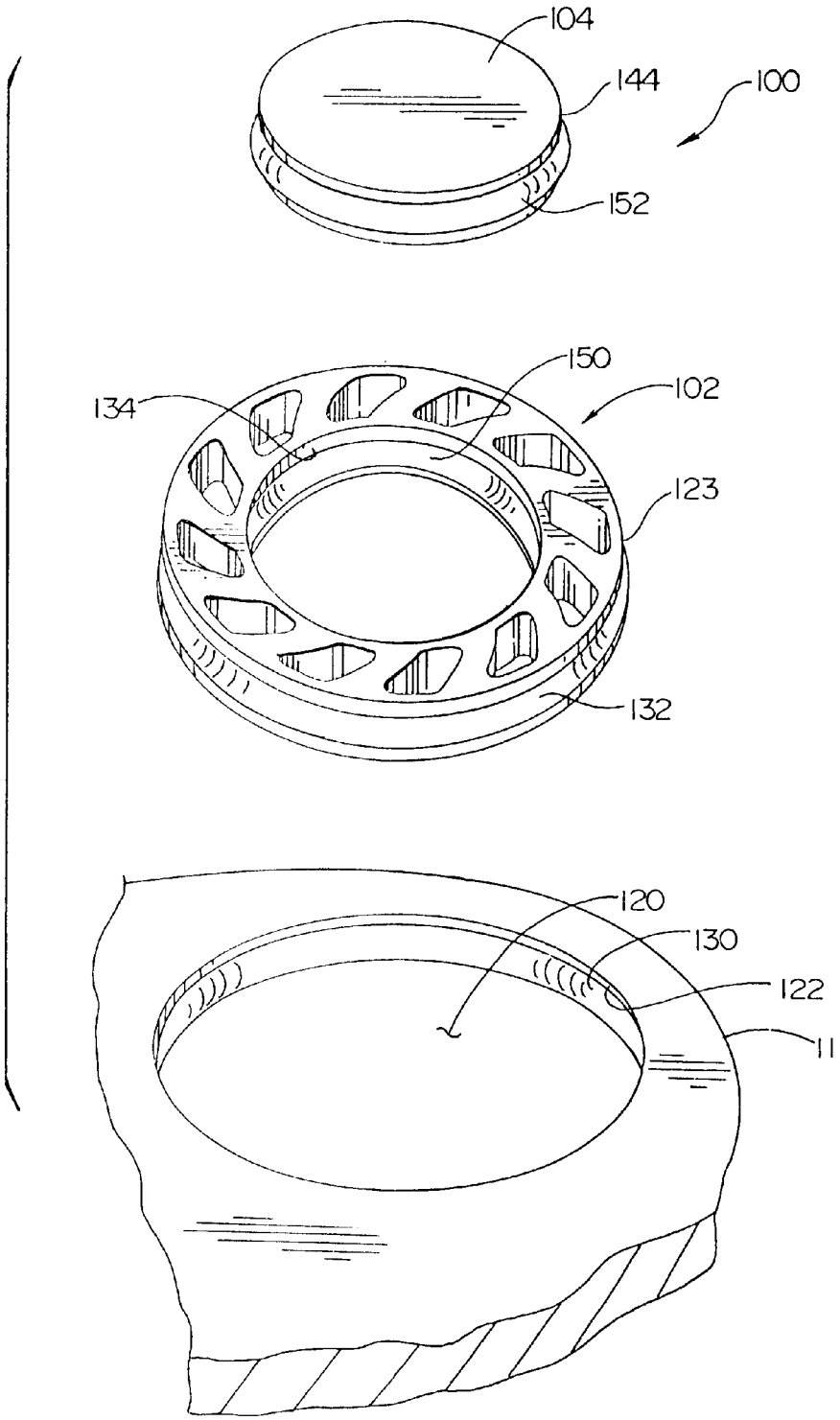
FIG. 12 is a close up partially exploded view of another embodiment of the present invention which illustrates an alternative means of attaching the damper to a pulley.

An alternative embodiment of the damper 100 and mounting region 120 may be seen in FIGS. 11 and 12. In the present embodiment the inner surface 122 of the mounting region 120 includes a protruding lip 130. The elastomeric portion 102 may be alternatively configured to include a mounting groove 132. The mounting groove 132 receives and frictionally engages the lip 130, thereby providing for a means of associating the elastomeric portion 102 with the mounting region 120.

In the various embodiments shown in FIGS. 7–12 the dampers 100 include weighted portions 104 which are retained within the central region 134 of the elastomeric portion 102. Different weighted portions 104 may be used with a given damper 100. Weighted portions having different masses may provide the damper 100 with varying performance characteristics which an individual user may find more or less desirable. As a result, different weighted portions may have a varying masses but should have substantially similar diameters in order to ensure that the weighted portions may be utilized with a given elastomeric portion.

The dampers 100 and particularly the weighted portions 104 of the damper 100 may be embodied in many different forms. For example, the weighted portion 104 shown in FIGS. 7–12 may be a distinct mass of material such as metal, plastic, rubber, etc, which may be different from or the same material as the elastomeric portion 102.

Figure 9:
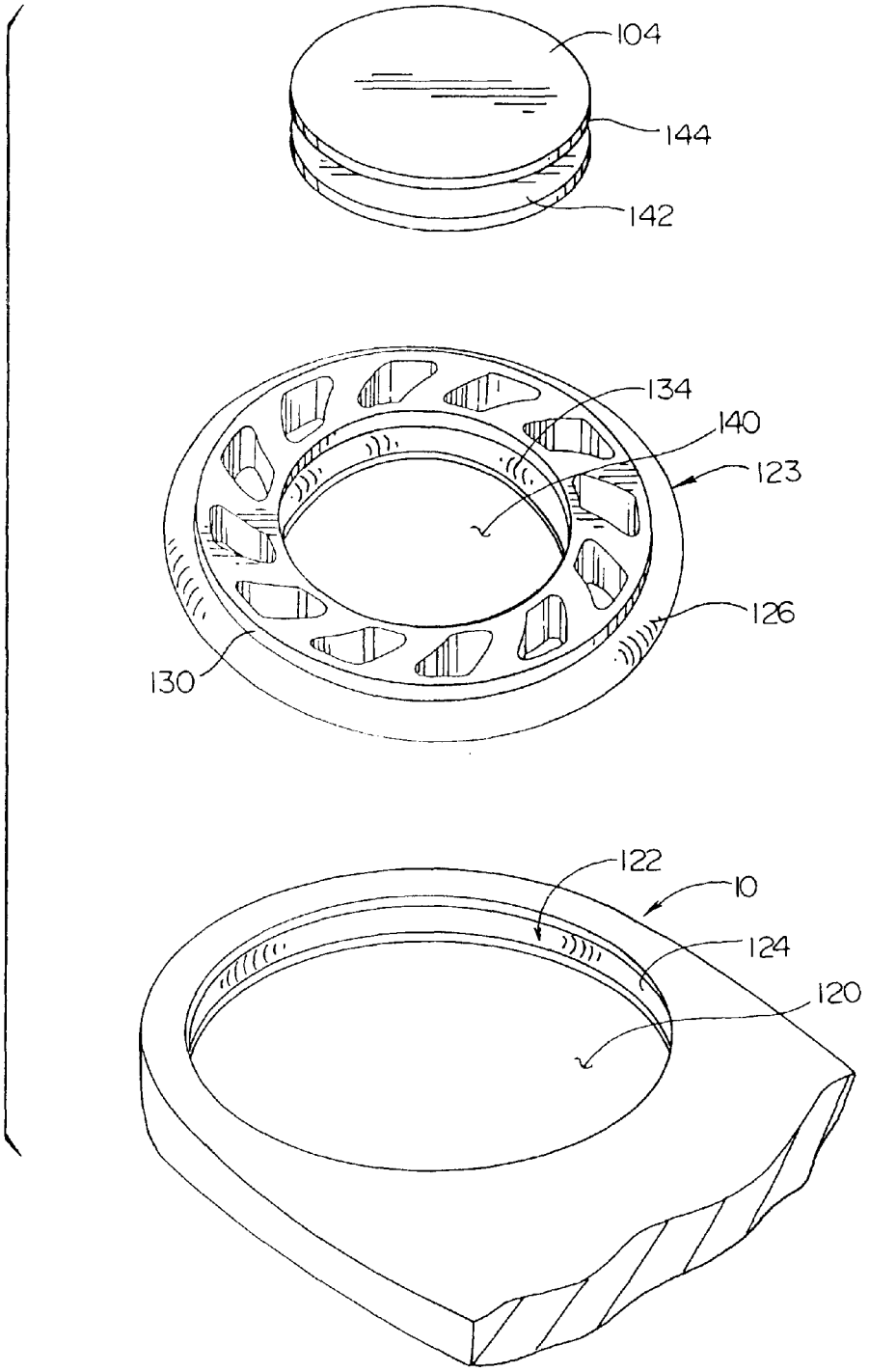
FIG. 9 is a close up partially exploded view of an embodiment of the present invention which illustrates one means of attaching the damper to a cam.
Figure 10:
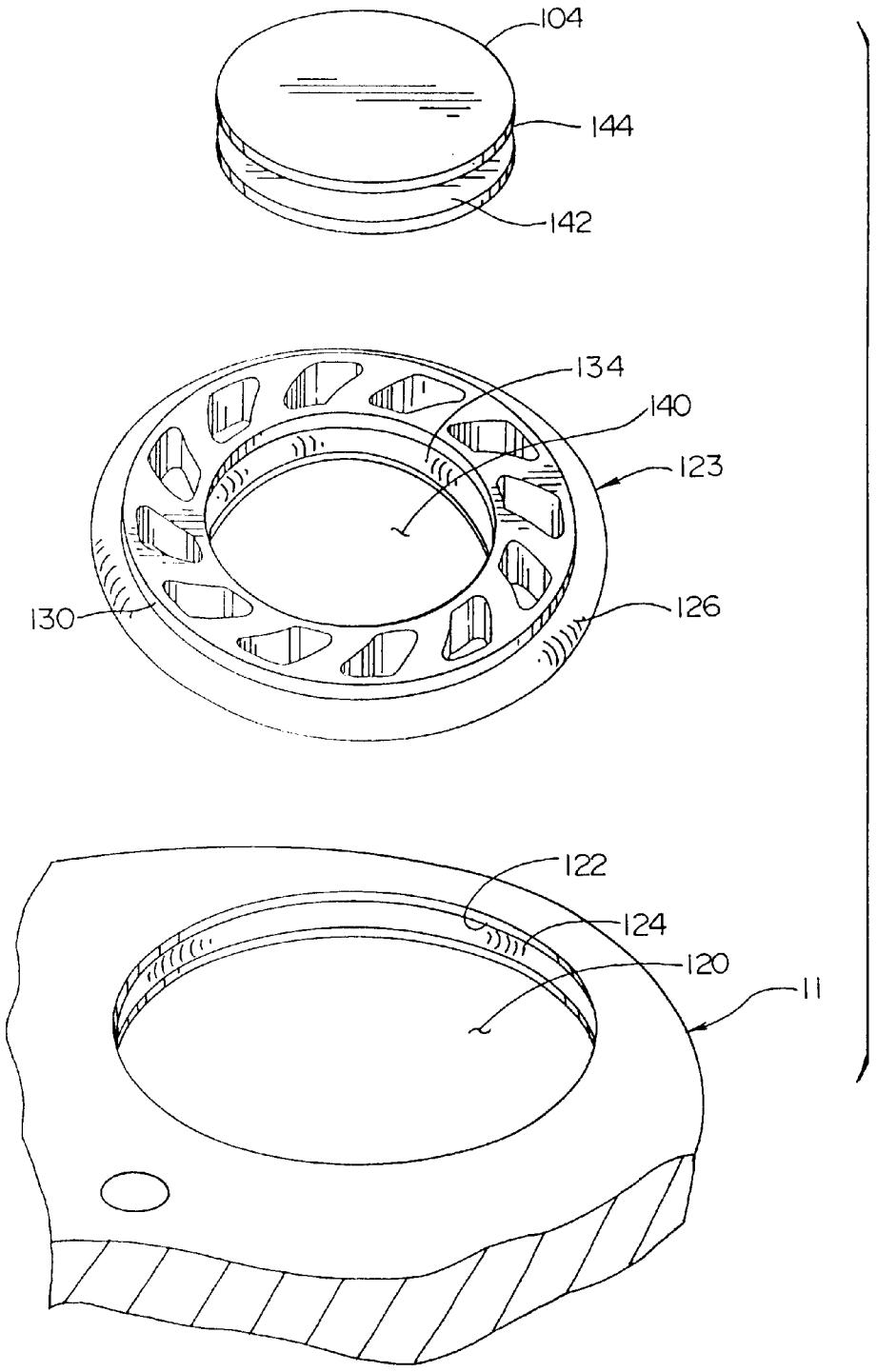
FIG. 10 is a close up partially exploded view of an embodiment of the present invention which illustrates one means of attaching the damper to a pulley.

In the embodiments shown in FIGS. 9 and 10 the central region 134 of the elastomeric portion 102 includes a mating portion 140. The mating portion 140 is constructed and arranged to be received and retained by a mating groove 142 located on the outside surface 144 of the weighted portion 104. In the embodiment shown in FIGS. 11 and 12 the central region 134 includes an elastomeric mating groove 150 which receives and retains a mating extension 152 of the weighted portion 102.

It should be noted that the various groove and collar arrangements shown in FIGS. 9–12 are merely examples of configurations which may be used to join the mounting region 120, the elastomeric portion 102 and the weighted portion 104. The configurations shown and described herein are preferred, as they allow a user to remove and replace the various components as desired. Alternative arrangements may include machining a thread pattern onto the respective surfaces of the mounting region and outside of the elastomeric portion so that the two surfaces may threadingly engage one another, the application of permanent or temporary adhesives as well as other interfacing arrangements. The present invention is directed at these configurations and all other which may be known to one of ordinary skill in the art.

Figure 13:
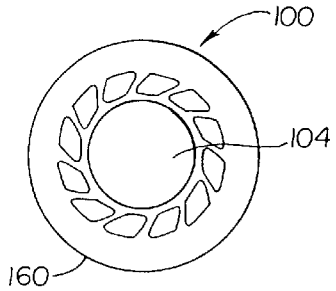
FIG. 13 is a perspective view of another embodiment of the present invention which includes a uniform dampening portion.

In an alternative embodiment shown in FIG. 13, the elastomeric portion 102 and the weighted portion 104 are composed of the same material and are not separate elements. The combined weighted portion 104 and elastomeric portion 102 together may form a vibration counteracting weight 160. Where the damper 100 comprises a counteracting weight 160, the counter acting weight may preferably be constructed from a fairly flexible material such as rubber, plastic or other flexible material.

Figure 13A:
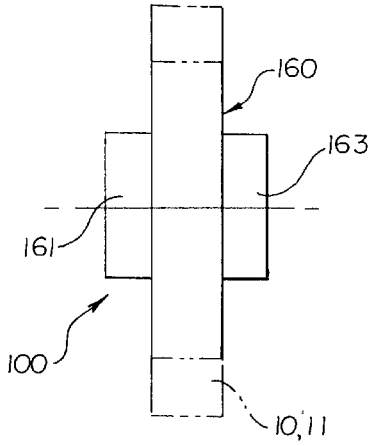
FIG. 13*a* is a side view of an alternative embodiment of the uniform dampening portion shown in FIG. 13.

It may be desirable for vibration absorbing purposes, to include a counteracting weight 160 which has a greater mass than the relatively slender disk shaped counteracting weight shown in FIG. 13. In an alternative embodiment shown in FIG. 13*a*, at least a portion of the counteracting weight 160 may extend beyond the thickness of the cam 10 or pulley 11 by extending the ends 161 and 163 beyond the cam 10 or pulley 11 surfaces respectively. The greater length and mass of counteracting weight 160 as shown in FIG. 13*a*, may provide the damper 100 with greater ability to counteract the vibrational forces present in the bow as previously described.

The counteracting weight 160 may be associated with mounting region 120 in the same manner as the elastomeric portion 102 such as the arrangements shown in FIGS. 9–12 as well as any other manner as may be understood by those of ordinary skill in the art.

Figure 14:
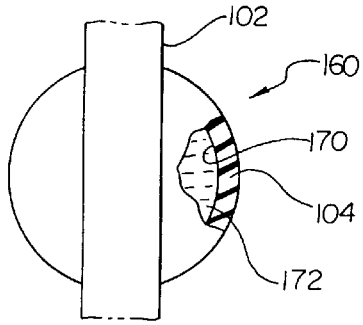
FIG. 14 is a side view of an embodiment of the invention which includes a weighted portion having a hollow region.
Figure 15:
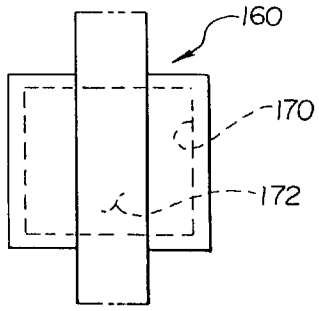
FIG. 15 is a side view of an alternative embodiment of the device shown in FIG. 13.

In yet another alternative embodiment shown in FIG. 14, the weighted portion 104 may define or include an enclosed hollow 170 which may contain a counteracting weight material 172 such as a fluid or other flowable material. Alternatively, the hollow 170 may be included within the counteracting weight 160 such as previously described and shown in FIGS. 13 and 13*a*. As shown in FIG. 15 the counteracting weight 160, defines a hollow 170. Where the counteracting weight 160 includes a hollow 170 as shown, the counteracting weight 160 may be constructed from virtually any material but is preferably constructed from metal such as aluminum, hardened rubber, or other suitable material.

In either of the embodiments shown in FIGS. 14 and 15, the hollow 170 comprises a predetermined volume of space which is at least partially occupied by the counteracting weight material 172.

The counteracting weight material 172 may be a fluid medium such as oil, water or liquid mercury and may alternatively or additionally include a plurality of particulate matter such as sand or beads composed of steel, lead, tungsten, brass, plastic, rubber or other material including but not limited to metal alloys. In alternative embodiments the hollow 170 may partially contain any variety or combination of counter acting weight material. The movement of the counteracting weight material 172 within the hollow 170 dampens and absorbs at least some of the vibrational energy which would otherwise be transferred from the bow to the user subsequent to releasing an arrow.

Figure 16:
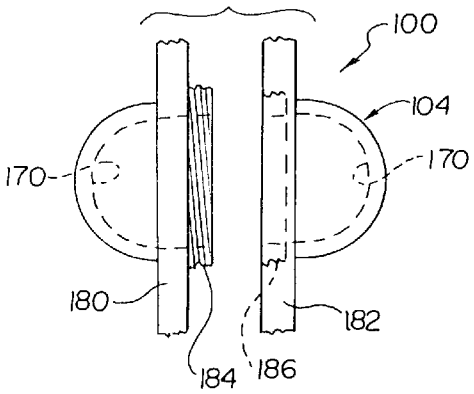
FIG. 16 is a side view of another embodiment of the device shown in FIG. 14, which illustrates one means of accessing the hollow.
Figure 17:
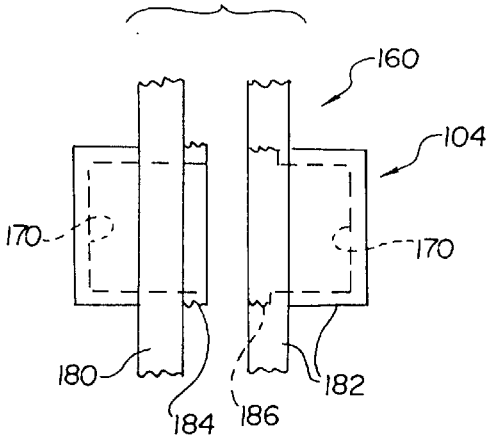
FIG. 17 is a side view of another embodiment of the device shown in FIG. 15, which illustrates one means of accessing the hollow.

In order to provide for the ability to customize the damper 100 to an individual user's preferences it may be desirable to provide the damper 100 with the ability to vary the mass of the weighted portion 104 or counteracting weight 160. As may be seen in FIGS. 16 and 17 respectively, the weighted portion 104 or counteracting weight 160 may be constructed to include a first half 180 and a second half 182 so that the hollow 170 may be opened and its contents removed and/or replaced. The first half 180 of the weighted portion 104 or counteracting weight 160 may include a first threaded portion 184 which threadingly engages an opposingly threaded second threaded portion 186 located about the second half 182. Such an arrangement will provide the hollow weighted portion 104 or counteracting weight 160 respectively, with the capacity to be readily manipulated by a user who may then access and vary the contents of the hollow 170 as may be desired.

Figure 18:
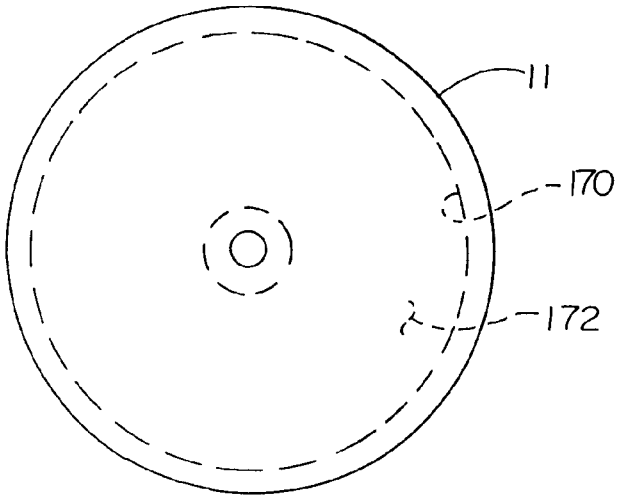
FIG. 18 is a side view of another embodiment of the invention.

In yet another embodiment of the present invention the damper 100 may be embodied as an inherent portion of the cam 10 or pulley 11. As may be seen in FIG. 18, the pulley 11, or a portion thereof, may include a hollow region 170. The hollow region 170 defines a predetermined volume of space which is at least partially occupied by counter acting weight material 172 as previously described.

Figure 19:
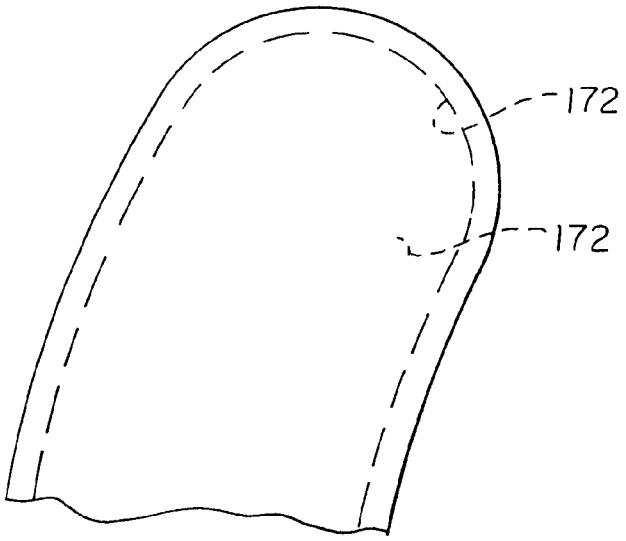
FIG. 19 is a side view of yet another embodiment of the invention.

Similarly, in the embodiment shown in FIG. 19, a portion of the cam 10 may include a hollow region 170. In the preferred embodiment shown, at least a portion of the cam arm 12 defines the hollow region 170. As previously described the hollow region 170 is at least partially filled with counteracting weight material 172.

It will be understood that this disclosure, in many respects, is only illustrative. Changes may be made in details, particularly in matters of shape, size, material, means of attachment, and arrangement of parts without exceeding the scope of the invention. Accordingly, the scope of the invention is as defined in the language of the claims.

What is claimed is:

1. A rotating member for use with a compound bow comprising a body, the body including a rotation point for journaling the body to a bow limb, the body including a damping device for absorbing vibrational energy as the rotating member vibrates against a bowstring when the rotating member returns to a rest position from a drawn position, the damping device further comprising a counteracting weight.

2. The rotating member of claim 1 wherein the counteracting weight is removably retained by the body.

3. The rotating member of claim 1 wherein the counteracting weight is fixedly attached to the body.

4. The rotating member of claim 1 wherein the counteracting weight is elastically attached to the body.

5. The rotating member of claim 1 wherein the body has a first predetermined thickness and at least a portion of the damping device has a second predetermined thickness, the second predetermined thickness of at least a portion of the damping device being greater than the first predetermined thickness of the body.

6. The rotating member of claim 1 wherein the counteracting weight defines an enclosed hollow region, the enclosed hollow region at least partially occupied by a counteracting weight material.

7. The rotating member of claim 6 wherein the counteracting weight material comprises a fluid.

8. The rotating member of claim 7 wherein the counteracting weight material further comprises a plurality of particulate solid material.

9. The rotating member of claim 6 wherein the counteracting weight material comprises a plurality of particulate solid material.

10. The rotating member of claim 6 wherein the counteracting weight material is selected from at least one member from the group consisting of: water, oil, mercury, a plurality of particulate plastic, a plurality of particulate rubber, sand, a plurality of particulate lead, a plurality of particulate tungsten, a plurality of particulate steel, a plurality of particulate brass and any alloys or combinations thereof.

11. The rotating member of claim 1 wherein the damping device is received by a damper mounting region of the body.

12. The rotating member of claim 11 wherein the body has a first predetermined thickness and at least a portion of the damping device has a second predetermined thickness, the second predetermined thickness of the at least a portion of the damping device being larger than the first predetermined thickness of the body.

13. The rotating member of claim 11 wherein the damping device is removably received by the damper mounting region of the body.

14. The rotating member of claim 11 wherein the counteracting weight is fixedly received by the damper mounting region.

15. The rotating member of claim 11 wherein the counteracting weight is elastically received by the damper mounting region.

16. The rotating member of claim 11 wherein the counteracting weight material comprises at least in part a fluid.

17. The rotating member of claim 16 wherein the counteracting weight material further comprises a plurality of particulate solid material.

18. The rotating member of claim 11 wherein the counteracting weight material comprises a plurality of particulate solid material.

19. The rotating member of claim 11 wherein the counteracting weight material is selected from at least one member from the group consisting of: water, oil, mercury, a plurality of particulate plastic, a plurality of particulate rubber, sand, a plurality of particulate lead, a plurality of particulate tungsten, a plurality of particulate steel, a plurality of particulate brass, and any alloys or combinations thereof.

20. The rotating member of claim 1 wherein the counteracting weight further comprises a resilient member and a weighted portion.

21. The rotating member of claim 20 wherein the weighted portion is removably received by the resilient portion.

22. The rotating member of claim 20 wherein the resilient member and the weighted portion are constructed of the same material.

23. The rotating member of claim 20 wherein the resilient member and the weighted portion are integrally formed.

24. The rotating member of claim 23 wherein the body has a first predetermined thickness and at least a portion of the damping device has a second predetermined thickness, the second predetermined thickness of at least a portion of the damping device being greater than the first predetermined thickness of the body.

25. The rotating member of claim 20 wherein the resilient member and the weighted portion are constructed of different materials.

26. The rotating member of claim 25 wherein the body has a first predetermined thickness and at least a portion of the damping device has a second predetermined thickness, the second predetermined thickness of at least a portion of the damping device being greater than the first predetermined thickness of the body.

27. The rotating member of claim 20 wherein the weighted portion defines an enclosed hollow region, the enclosed hollow region at least partially occupied by a counteracting weight material.

28. The rotating member of claim 27 wherein the counteracting weight material comprises a fluid.

29. The rotating member of claim 28 wherein the counteracting weight material further comprises a plurality of particulate solid material.

30. The rotating member of claim 27 wherein the counteracting weight material comprises a plurality of particulate solid material.

31. The rotating member of claim 27 wherein the counteracting weight material is selected from at least one member from the group consisting of: water, oil, mercury, a plurality of particulate plastic, a plurality of particulate rubber, sand, a plurality of particulate lead, a plurality of particulate tungsten, a plurality of particulate steel, a plurality of particulate brass, and any alloys or combinations thereof.

32. The rotating member of claim 1 wherein the dampening portion is an integral portion of the body.

33. The rotating member of claim 1 wherein a least a portion of the body defines an enclosed hollow region, the enclosed hollow region at least partially occupied by a counter acting weight material.

34. The rotating member of claim 33 wherein the counteracting weight material comprises a fluid.

35. The rotating member of claim 34 wherein the counteracting weight material further comprises a plurality of particulate solid material.

36. The rotating member of claim 33 wherein the counteracting weight material comprises a plurality of particulate solid material.

37. The rotating member of claim 33 wherein the counteracting weight material is elected from at least one member from the group consisting of: water, oil, mercury, a plurality of particulate plastic, a plurality of particulate rubber, sand, a plurality of particulate lead, a plurality of particulate tungsten, a plurality of particulate steel, a plurality of particulate brass, and any alloys or combinations thereof.

* * * * *